US009114501B2

(12) United States Patent
Takeuchi et al.

(10) Patent No.: US 9,114,501 B2
(45) Date of Patent: Aug. 25, 2015

(54) POLISHING PAD

(75) Inventors: Nana Takeuchi, Otsu (JP); Seiji Fukuda, Otsu (JP); Ryoji Okuda, Otsu (JP); Shigetaka Kasai, Urayasu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 0 days.

(21) Appl. No.: 14/232,785

(22) PCT Filed: Jul. 12, 2012

(86) PCT No.: PCT/JP2012/067840

§ 371 (c)(1),
(2), (4) Date: Jan. 14, 2014

(87) PCT Pub. No.: WO2013/011922

PCT Pub. Date: Jan. 24, 2013

(65) Prior Publication Data

US 2014/0154962 A1 Jun. 5, 2014

(30) Foreign Application Priority Data

Jul. 15, 2011 (JP) ..... 2011-156425

(51) Int. Cl.
*B24B 37/22* (2012.01)
*B24B 37/24* (2012.01)
*B24B 37/26* (2012.01)

(52) U.S. Cl.
CPC ..... *B24B 37/26* (2013.01); *B24B 37/22* (2013.01)

(58) Field of Classification Search
CPC ..... B24B 37/22; B24B 37/26
USPC ..... 51/297; 451/527, 529, 533, 550
See application file for complete search history.

(56) References Cited

U.S. PATENT DOCUMENTS 5,882,251 A * 3/1999 Berman et al. ..... 451/527
6,019,666 A * 2/2000 Roberts et al. ..... 451/36
7,090,572 B2 * 8/2006 Ito ..... 451/458

(Continued)

FOREIGN PATENT DOCUMENTS

JP 2002-144219 A 5/2002
JP 2003-163192 A 6/2003

(Continued)

OTHER PUBLICATIONS

International Search Report for PCT/JP2012/067840 mailed on Aug. 7, 2012.
Written Opinion of the International Searching Authority for PCT/JP2012/067840 mailed on Aug. 7, 2012.
Singaporean Search Report and Written Opinion dated Sep. 8, 2014, for Singaporean Application No. 2014003164.

*Primary Examiner* — Timothy V Eley
(74) *Attorney, Agent, or Firm* — Birch, Stewart, Kolasch & Birch, LLP

(57) ABSTRACT

A polishing pad includes at least a cushion layer and a polishing layer including a groove, on a polishing surface, having side surfaces and a bottom surface, wherein at least one of the side surfaces includes a first side surface that extends continuously to the polishing surface and forms an angle α with the polishing surface, and a second side surface that extends continuously to the first side surface and forms an angle β with a plane parallel to the polishing surface, the angle α is larger than 90 degrees, the angle β is not smaller than 85 degrees, and the angle β is smaller than the angle α, a bending point depth is not less than 0.4 mm and not more than 3.0 mm, and the cushion layer has a distortion constant of not less than $7.3\times10^{-6}$ μm/Pa and not more than $4.4\times10^{-4}$ μm/Pa.

7 Claims, 2 Drawing Sheets

(56) References Cited

U.S. PATENT DOCUMENTS

| | | | | |
|---|---|---|---|---|
| 8,002,611 | B2 * | 8/2011 | He et al. | 451/527 |
| 8,128,464 | B2 * | 3/2012 | Motonari et al. | 451/527 |
| 2003/0114084 | A1 | 6/2003 | Moon et al. | |
| 2007/0178812 | A1 | 8/2007 | Shimomura et al. | |
| 2009/0075568 | A1 * | 3/2009 | Kimura et al. | 451/59 |
| 2010/0056031 | A1 * | 3/2010 | Chiu et al. | 451/527 |
| 2014/0141704 | A1 * | 5/2014 | Takeuchi et al. | 451/529 |
| 2014/0170943 | A1 * | 6/2014 | Takeuchi et al. | 451/527 |
| 2014/0342646 | A1 * | 11/2014 | Honda et al. | 451/527 |
| 2014/0378035 | A1 * | 12/2014 | Noro et al. | 451/528 |

FOREIGN PATENT DOCUMENTS

| | | | |
|---|---|---|---|
| JP | 2004-186392 | A | 7/2004 |
| JP | 2005-236200 | A | 9/2005 |
| JP | 2009-23018 | A | 2/2009 |
| JP | 2009-148876 | A | 7/2009 |
| JP | 2010-45306 | A | 2/2010 |

* cited by examiner

POLISHING PAD

FIELD

The present invention relates to a polishing pad. More particularly, the present invention relates to a polishing pad preferably used in order to form a flat surface in a semiconductor, a dielectric/metallic composite, an integrated circuit, and the like.

BACKGROUND

As the density of a semiconductor device becomes higher, the importance of technologies such as multilayer wiring, and formation of interlayer insulating films and electrodes (such as a plug and a damascene structure) associated with the multilayer wiring is increasing. At the same time, the importance of planarization processes of the interlayer insulating films and the electrode metal films is increasing. As an efficient technology for the planarization processes, a polishing technology called CMP (Chemical Mechanical Polishing) is widespread.

The CMP apparatus generally includes a polishing head that holds a semiconductor wafer as a subject to be processed, a polishing pad for performing a polishing process of a subject to be processed, and a polishing platen that holds the polishing pad. In a polishing process of a semiconductor wafer using a slurry, a semiconductor wafer and a polishing pad move relative to each other, so that projections of a semiconductor wafer surface layer are removed to planarize the wafer surface layer. A pad surface is updated by dressing with a diamond dresser and the like for clogging prevention and setting.

The polishing properties of CMP include various requirement properties represented by wafer local flatness, securing of global flatness, prevention of scratches, securing of a high polishing rate, and the like. Therefore, in order to achieve these, various designs are provided in a groove configuration (such as a groove pattern and a groove cross-sectional shape) of a polishing pad. The groove configuration is one of the largest factors affecting the polishing properties.

For example, there is known a technology to improve wafer flatness and a polishing rate by providing a groove that is arranged on a polishing layer surface and has a concentric circular pattern and a substantially rectangular cross-sectional shape (for example, see Patent Literature 1).

However, in this technology, corners in a cross-sectional shape of a groove and burr-like materials formed in the corners caused by dressings performed prior to, following to, or during polishing may sometimes cause generation of scratches. To solve this problem, there is disclosed a technology of providing an inclined surface at a boundary between a polishing surface and a groove (for example, see Patent Literatures 2 and 3).

CITATION LIST

Patent Literature

Patent Literature 1: Japanese Laid-open Patent Publication No. 2002-144219

Patent Literature 2: Japanese Laid-open Patent Publication No. 2004-186392

Patent Literature 3: Japanese Laid-open Patent Publication No. 2010-45306

SUMMARY

Technical Problem

When the groove cross-sectional shape is substantially rectangular, there have been problems that the polishing rate is not sufficient and that the polishing rate is likely to vary especially in the initial to middle stages of polishing in addition to the above-described problem.

Here, the inventors have found that an inclined surface is provided at a boundary between a polishing surface and a groove, so that not only scratches are reduced, but also improvement in suction and slurry flow between a wafer and a polishing pad is developed to make the polishing rate higher than that of a polishing pad having a groove with a substantially rectangular cross-sectional shape. However, the inventors have also found that as a polishing layer is scraped off by dressing with a diamond dresser, a groove width of a groove with such a structure gradually decreases to reduce a groove volume, resulting in a decrease in the polishing rate in the later stage of polishing. Moreover, the inventors have found that variation of a polishing rate becomes larger in specific physical properties of a cushion layer.

In view of the above problems associated with conventional technologies, an object of the present invention is to provide a polishing pad that, among other polishing properties, can suppress variation of a polishing rate while maintaining a high polishing rate.

Solution to Problem

The inventors considered that an angle at a boundary between a polishing surface and a groove affects variation of a polishing rate. Moreover, the inventors considered that unevenness in suction and slurry flow on a polishing surface occurs under influence of a cushion layer, resulting in variation of a polishing rate, and that in order to prevent this, the problem can be solved by combining a substance having rigidity into the cushion layer.

Therefore, the present invention employs the following means to solve the above problems. That is, a polishing pad includes at least a polishing layer and a cushion layer, wherein the polishing layer comprises a groove on a polishing surface, the groove having side surfaces and a bottom surface, at least one of the side surfaces comprises a first side surface that extends continuously to the polishing surface and forms an angle $\alpha$ with the polishing surface, and a second side surface that extends continuously to the first side surface and forms an angle $\beta$ with a plane parallel to the polishing surface, the angle $\alpha$ formed with the polishing surface is larger than 90 degrees, the angle $\beta$ formed with the plane parallel to the polishing surface is not smaller than 85 degrees, and the angle $\beta$ formed with the plane parallel to the polishing surface is smaller than the angle $\alpha$ formed with the polishing surface, a bending point depth from the polishing surface to a bending point between the first side surface and the second side surface is not less than 0.4 mm and not more than 3.0 mm, and the cushion layer has a distortion constant of not less than $7.3\times10^{-6}$ μm/Pa and not more than $4.4\times10^{-4}$ μm/Pa.

Advantageous Effects of Invention

According to the present invention, a polishing pad that can suppress variation of a polishing rate while maintaining a high polishing rate can be provided.

DESCRIPTION OF EMBODIMENTS

Figure 1:
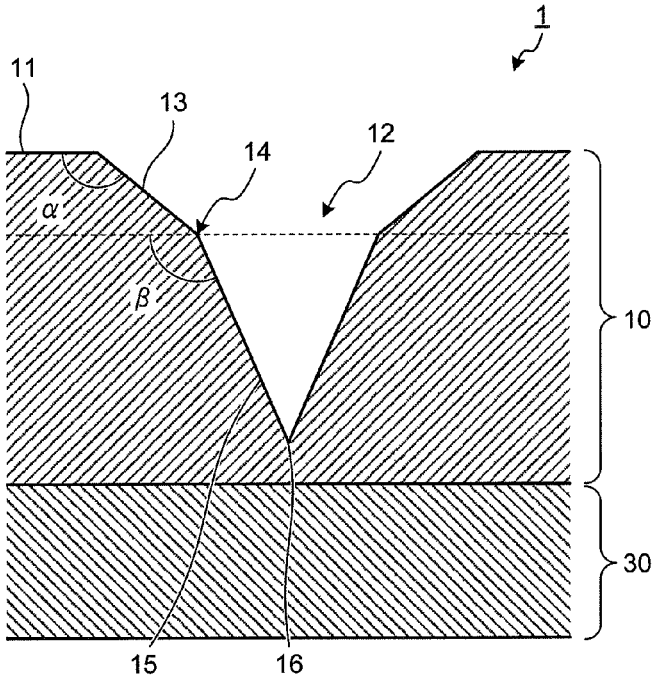
FIG. 1 is a partial cross-sectional view illustrating a configuration of a main part of a polishing pad according to an embodiment of the present invention.

Embodiments for carrying out the present invention will be described below.

The inventors extensively studied a polishing pad that can suppress variation of a polishing rate while maintaining a high polishing rate. As a result, the inventors found that the problems can be solved once for all by configuring a polishing pad having at least a polishing layer and a cushion layer, wherein the polishing layer includes a groove on a polishing surface, and the groove has side surfaces and a bottom surface; at least one of the side surfaces includes a first side surface that extends continuously to the polishing surface and forms an angle $\alpha$ with the polishing surface, and a second side surface that extends continuously to the first side surface and forms an angle $\beta$ with a plane parallel to the polishing surface; the angle $\alpha$ formed with the polishing surface is larger than 90 degrees, the angle $\beta$ formed with the plane parallel to the polishing surface is not smaller than 85 degrees, and the angle $\beta$ formed with the plane parallel to the polishing surface is smaller than the angle $\alpha$ formed with the polishing surface; a bending point depth from the polishing surface to a bending point between the first side surface and the second side surface is not less than 0.4 mm and not more than 3.0 mm, and a distortion constant of the cushion layer is not less than $7.3\times10^{-6}$ μm/Pa and not more than $4.4\times10^{-4}$ μm/Pa.

In the present invention, it is important that a polishing pad has at least a polishing layer and a cushion layer. When a cushion layer is not provided, distortion caused by, for example, water absorption of a polishing layer cannot be buffered. Therefore, a polishing rate and in-plane uniformity of a material to be polished vary unstably. Moreover, even when a cushion layer is provided, an extremely large distortion constant leads to unstable variation of a polishing rate and in-plane uniformity of a material to be polished. Therefore, the distortion constant is not less than $7.3\times10^{-6}$ μm/Pa and not more than $4.4\times10^{-4}$ μm/Pa. When the distortion constant of a cushion layer falls within this range, variation of a polishing rate can substantially be suppressed while maintaining an effect of improving a polishing rate by the groove having an inclination. From a viewpoint of polishing rate variation and local flatness of a material to be polished, the upper limit is more preferably not more than $3.0\times10^{-4}$ μm/Pa, and further preferably not more than $1.5\times10^{-4}$ μm/Pa. Moreover, the lower limit is more preferably not less than $1.0\times10^{-5}$ μm/Pa, and further preferably not less than $1.2\times10^{-5}$ μm/Pa. When the polishing rate variation is large, a polishing amount of a material to be polished varies. As a result, a remaining film thickness of a material to be polished varies, thereby adversely affecting performance of a semiconductor device. Therefore, the polishing rate variation is preferably not higher than 15%, and more preferably not higher than 10%.

A distortion constant in the present invention is a value calculated according to the following equation:

$$\text{Distortion constant}(\mu m/Pa)=(T1-T2)/(177-27)/1000,$$

wherein T1 (μm) is a thickness when a pressure of 27 kPa is applied for 60 seconds with a dial gauge using an indenter having a leading end diameter of 5 mm, and T2 (μm) is a thickness when a pressure of 177 kPa is applied for 60 seconds thereafter.

Examples of such a cushion layer may include, but are not limited to, natural rubber, nitrile rubber, "Neoprene (registered trademark)" rubber, polybutadiene rubber, thermosetting polyurethane rubber, thermoplastic polyurethane rubber, silicone rubber, non-foamed elastomer such as "Hytrel (registered trademark)", a polyolefin foamed body such as "Toraypef (registered trademark, PEF manufactured by Toray Industries, Inc.)", and non-woven fabric such as "Suba 400" manufactured by Nitta Haas Incorporated.

The distortion constant of the cushion layer can be adjusted depending on a material thereof. For example, when the cushion layer is a foamed body, increasing a foaming degree tends to cause the foamed body to become soft. Therefore, the distortion constant tends to increase. Moreover, when the cushion layer is non-foamed, hardness can be controlled by adjusting a crosslinking degree in the cushion layer.

The thickness of the cushion layer is preferably 0.1 to 2 mm. From a viewpoint of in-plane uniformity on a whole surface of a semiconductor substrate, the thickness is preferably not less than 0.25 mm, and more preferably not less than 0.3 mm. Moreover, from a viewpoint of local flatness, the thickness is preferably not more than 2 mm, and more preferably not more than 1 mm.

The polishing layer surface of the polishing pad according to the present invention has a groove. Examples of a shape of the groove as seen from the polishing layer surface may include, but are not limited to, lattice, radial, concentric circular, and spiral shapes. When the groove is an open-type and extends in a circumferential direction, slurry can be efficiently updated. Therefore, a lattice shape is the most preferable.

According to the present invention, the groove has side surfaces and a bottom surface, and at least one of the side surfaces thereof includes a first side surface that extends continuously from a polishing surface and forms an angle $\alpha$ with the polishing surface, and a second side surface that extends continuously from the first side surface and forms an angle $\beta$ with a plane parallel to the polishing surface. Each of the first side surface, the second side surface, and the bottom surface may be plane (linear in a cross-sectional shape of the groove) or curved (curved in a cross-sectional shape of the groove).

In the present invention, the angle $\alpha$ is larger than 90 degrees, the angle $\beta$ is larger than 85 degrees, and the angle $\beta$ is smaller than the angle $\alpha$. Thus, variation of a polishing rate can be suppressed while maintaining a high polishing rate. This can be explained as below. Variation of a polishing rate is generally large in initial and middle stages of polishing. However, by providing an inclined surface having an angle larger than 90 degrees at a boundary between the polishing surface and the groove, not only a polishing rate increases, but also such variation of a polishing rate in initial and middle stages can be effectively suppressed.

On the other hand, when a polishing layer of the groove having such a configuration is scraped off as dressing is performed with a diamond dresser, a groove width gradually decreases, and a groove volume becomes smaller. The reduction rate of a groove volume is faster than that for a common rectangular shape. Therefore, as polishing proceeds further, a slurry discharge capacity decreases, and a defect on a material to be polished increases. Thus, it is concerned that a polishing rate in the later stage of polishing decreases. Therefore, a groove preferably has a configuration in which the reduction rate of a groove volume decreases after a given depth. By adjusting the angle α and the angle β as described above, such an object can be achieved. A difference between the angle α and the angle β is preferably not smaller than 10 degrees and not larger than 65 degrees, and further preferably not less than 20 degrees and not more than 60 degrees.

From a viewpoint of retention and fluidity of slurry, the lower limit of the angle α is preferably not smaller than 105 degrees, and more preferably not smaller than 115 degrees. Moreover, the upper limit of the angle α is preferably not larger than 150 degrees, and more preferably not larger than 140 degrees. Both the side surfaces forming a groove and facing each other may have a similar shape. However, since slurry flows due to a centrifugal force, it is more effective that, of the side surfaces forming a groove and facing each other, at least the side surface on a circumferential side has an inclination.

Furthermore, in order to particularly stabilize variation of a polishing rate, a shape formed by the second side surface and the bottom surface is preferably substantially rectangular (a "C" shape). This is because not only a polishing rate does not vary even in the later stage of polishing, but also a polishing rate can be stabilized for longer periods on the contrary. Considering that a high polishing rate cannot be maintained when a groove has a simple shape of a substantial rectangle like a conventional technology, this is an unexpected effect. The reason is not known, but it is considered that this is because in the later stage of polishing, a groove width is maintained to be substantially uniform, and a polishing stabilization effect due to a decreased groove volume reduction rate becomes large.

The substantially rectangular shape described here is not limited to a complete square or rectangle, but refers to a shape that may include a groove side surface with a little inclination, or a shape that may include a groove side surface and a bottom surface each having at least partly a curved surface. The angle β formed between a plane parallel to the polishing surface and the second side surface is preferably not smaller than 85 degrees and not larger than 95 degrees. In order to achieve easy groove processing, the angle β is more preferably not smaller than 88 degrees and not larger than 92 degree, and most preferably 90 degrees.

The width of the groove bottom of a rectangular part is preferably not less than 0.1 mm from a viewpoint of a slurry discharge capacity, and preferably not more than 4.0 mm in order to inhibit an extreme high discharge capacity that causes slurry on a polishing surface to become insufficient. The width is more preferably not less than 0.3 mm and not more than 2 mm, and further preferably not less than 0.5 mm and not more than 1.5 mm. Moreover, for easy groove processing, the width is preferably smaller than a groove opening width on a polishing surface.

When a polishing layer is scraped off as a material to be polished is polished and the polishing surface passes a bending point that is a boundary between the first side surface and the second side surface, variation of a polishing rate can occur. Therefore, the life of a polishing pad can be easily recognized. The depth from the polishing surface to the bending point is preferably not less than a depth level at which an effect of an inclined groove part on the polishing surface side is not reduced, and not more than a depth level at which an effect by providing a rectangular shape can be maintained. Specifically, since it is preferable that the life of a polishing pad be long, the depth is preferably not less than 50% and not more than 95% of the depth of the entire groove, and more preferably not less than 66% and not more than 90%.

Furthermore, when a polishing layer is scraped off as dressing is performed with a diamond dresser and a groove side surface in the shallowest part is changed from the first side surface to the second side surface, variation of a polishing rate occurs and a slurry discharge capacity is also changed. Since it is a problem to be solved that variation of a polishing rate in the later stage of polishing is stabilized, the bending point depth from the polishing surface to the bending point between the first side surface and the second side surface is not less than 0.4 mm and not more than 3.0 mm. When the bending point depth is deep, a slurry discharge capacity becomes insufficient. When the bending point depth is shallow, since the distance to a bending point where a stable polishing rate is obtained is short, the life of a polishing pad becomes short. The upper limit of the bending point depth is preferably not more than 2.5 mm, more preferably not more than 2.0 mm, and further preferably not more than 1.8 mm. The lower limit of the bending point depth is preferably not less than 0.5 mm, more preferably not less than 0.65 mm, further preferably not less than 1.0 mm.

A specific shape of the groove according to the present invention as described above will be described with reference to the drawings. FIG. 1 is a partial cross-sectional view illustrating the configuration of a main part of a polishing pad according to an embodiment of the present invention. A polishing pad 1 shown in FIG. 1 has a polishing layer 10, and a cushion layer 30 laminated on a surface opposite to a polishing surface 11 of the polishing layer 10. A groove 12 is formed on the polishing surface 11 of the polishing layer 10. The groove 12 has a first side surface 13 that extends continuously to the polishing surface 11 and inclines at an angle α formed with respect to the polishing surface 11, a second side surface 15 that extends continuously to the first side surface 13 and bends with respect to the first side surface 13 at a bending point 14, and a deepest groove part 16. An angle β of the second side surface with respect to a plane parallel to the polishing surface 11 is smaller than the angle α of the first side surface 13 with respect to the polishing surface 11.

Figure 2:
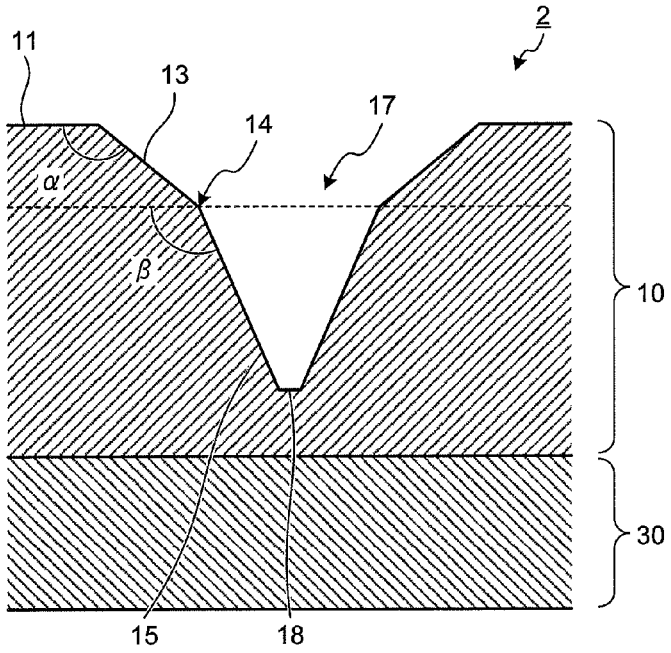
FIG. 2 is a partial cross-sectional view illustrating the configuration (second example) of a main part of a polishing pad according to an embodiment of the present invention.
Figure 3:
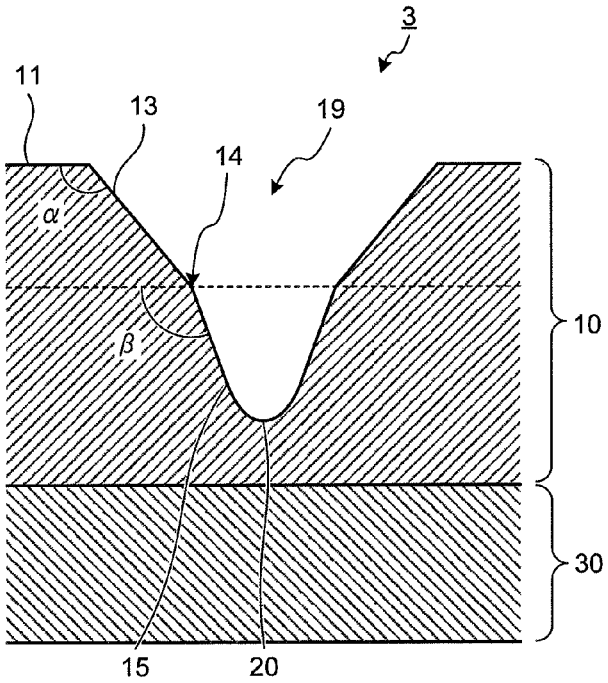
FIG. 3 is a partial cross-sectional view illustrating the configuration (third example) of a main part of a polishing pad according to an embodiment of the present invention.
Figure 4:
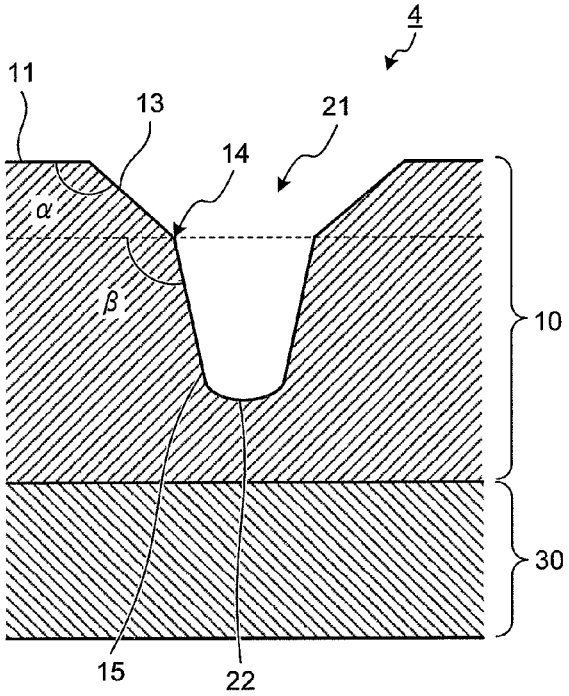
FIG. 4 is a partial cross-sectional view illustrating the configuration (fourth example) of a main part of a polishing pad according to an embodiment of the present invention.

Here, a groove shape configured by the second side surfaces 15 and the deepest part 16 is not limited to the shape illustrated in FIG. 1. For example, like a groove 17 of a polishing pad 2 illustrated in FIG. 2, a deepest part 18 may have a bottom surface substantially parallel to the polishing surface 11. Moreover, like a groove 19 of a polishing pad 3 illustrated in FIG. 3, a boundary part between the second side surface 15 and a deepest part 20 may constitute a curved surface. Moreover, like a groove 21 of a polishing pad 4 shown in FIG. 4, the cross-sectional shape of second side surfaces 15 and a deepest part 22 may constitute a U-shape (being part of a substantial rectangle).

As shown in FIGS. 1 to 4, a cross-sectional shape of the groove according to the present invention can be specifically represented by a substantial Y-shape. These shapes are shown as an example, and the substantially rectangular shape in the present invention is not limited to these.

As the polishing layer constituting the polishing pad, a closed cell structure is preferable, because a flat surface is formed in a semiconductor, a dielectric/metallic composite, an integrated circuit, and the like. The hardness of the polishing layer measured by an Asker D hardness meter is preferably 45 to 65 degrees. When the Asker D hardness is less than 45 degrees, flatness properties (planarity) of a material to be polished decrease. When the Asker D hardness is more than 65 degrees, flatness properties (planarity) is favorable. However, as wafer in-plane uniformity of a polishing rate for a material to be polished decreases, uniformity of wafer in-plane planarization properties (planarity) tends to decrease.

Examples of a material for forming such a structure may include, but are not particularly limited to, polyethylene, polypropylene, polyester, polyurethane, polyurea, polyamide, polyvinyl chloride, polyacetal, polycarbonate, polymethyl methacrylate, polytetrafluoroethylene, epoxy resin, ABS resin, AS resin, phenol resin, melamine resin, "Neoprene (registered trademark)" rubber, butadiene rubber, styrene butadiene rubber, ethylene propylene rubber, silicone rubber, fluorine rubber, and resins including these as a main component. Two or more of these may be used. Moreover in these resins, since a closed cell diameter can be relatively easily controlled, a material including polyurethane as a main component is more preferable.

Polyurethane is a macromolecule synthesized by a polyaddition reaction or a polymerization reaction of polyisocyanate. A compound used as a reference of polyisocyanate is an active hydrogen-containing compound that is a compound containing two or more polyhydroxy groups or an amino group-containing compound. Examples of polyisocyanate may include, but are not limited to, tolylene diisocyanate, diphenylmethane diisocyanate, naphthalene diisocyanate, hexamethylene diisocyanate, and isophorone diisocyanate. Two or more of these may be used.

A compound containing a polyhydroxy group is representatively polyol. Examples thereof may include polyether polyol, polytetramethylene ether glycol, epoxy resin-modified polyol, polyester polyol, acrylic polyol, polybutadiene polyol, and silicone polyol. Two or more of these may be used. Combination and optimum amounts of polyisocyanate and polyol, and a catalyst, a foaming agent and a foam stabilizer are preferably determined depending on hardness, a cell diameter and a foaming ratio.

As a method of forming closed cells in the polyurethane, a chemical foaming method in which various foaming agents are blended into a resin during production of polyurethane is generally used. However, a method including foaming a resin by mechanical stirring and thereafter curing the foamed resin may also preferably be used. Moreover, a hollow particular polymer having a void inside can be kneaded during manufacture of polyurethane.

The average cell diameter of closed cells is preferably not less than 30 μm in order to reduce scratches. Moreover, in view of flatness of local unevenness of a material to be polished, the average cell diameter is preferably not more than 150 μm, more preferably not more than 140 μm, and further preferably not more than 130 μm. The average cell diameter is obtained as follows. Of cells observed in one field of view when observing a sample section at a magnification of 400 times using an ultra-deep microscope VK-8500 manufactured by Keyence Corporation, circular cells excluding cells that are observed in a circle in a state of being deficient in the field end are measured using an image processing apparatus to obtain a circle-equivalent diameter from the cross-sectional area. Then, a number average value is calculated.

A preferred embodiment of the polishing pad according to the present invention is a pad that contains a polymer of a vinyl compound as well as polyurethane and has closed cells. With only a polymer from a vinyl compound, toughness and hardness can be improved, but a uniform polishing pad having closed cells is unlikely to be obtained. Furthermore, polyurethane becomes brittle when hardness is brought to be higher. By impregnating a vinyl compound into polyurethane, a polishing pad containing closed cells and having high toughness and hardness can be obtained.

A vinyl compound is a polymerizable compound having a carbon-carbon double bond. Specific examples of the vinyl compound may include methyl acrylate, methyl methacrylate, ethyl acrylate, ethyl methacrylate, n-butyl acrylate, n-butyl methacrylate, 2-ethylhexyl methacrylate, isodecyl methacrylate, n-lauryl methacrylate, 2-hydroxy ethyl methacrylate, 2-hydroxy propyl methacrylate, 2-hydroxy butyl methacrylate, dimethylaminoethyl methacrylate, diethylaminoethyl methacrylate, glycidyl methacrylate, ethylene glycol dimethacrylate, acrylic acid, methacrylic acid, fumaric acid, dimethyl fumarate, diethyl fumarate, dipropyl fumarate, maleic acid, dimethyl maleate, diethyl maleate, dipropyl maleate, phenylmaleimide, cyclohexyl maleimide, isopropyl maleimide, acrylonitrile, acrylamide, vinyl chloride, vinylidene chloride, styrene, α-methylstyrene, divinylbenzene, ethylene glycol dimethacrylate, and diethylene glycol dimethacrylate. Two or more of these may be used.

Among the above-described vinyl compounds, CH2═CR1COOR2 (R1: a methyl group or an ethyl group, R2: a methyl group, an ethyl group, a propyl group, or a butyl group) is preferable. Especially, methyl methacrylate, ethyl methacrylate, n-butyl methacrylate, and isobutyl methacrylate are preferable. This is because closed cells can be easily formed into polyurethane; monomers can be favorably impregnated; polymerization curing can be easily performed; and a foaming structure containing a polymer of a polymerization-cured vinyl compound and polyurethane has high hardness and favorable planarization properties.

Examples of a polymerization initiator preferably used for obtaining these polymers of vinyl compounds may include a radical initiator such as azobisisobutyronitrile, azobis(2,4-dimethylvaleronitrile), azobis cyclohexane carbonitrile, benzoyl peroxide, lauroyl peroxide, and isopropyl peroxy dicarbonate. Two or more of these may be used. Moreover, a redox-based polymerization initiator, for example, a combination of peroxide and amines can be used.

A method of impregnating a vinyl compound into polyurethane may include a method including immersing polyurethane in a vessel containing a vinyl compound. At that time, treatments such as heating, pressurizing, pressure-reducing, stirring, shaking, and ultrasonic vibration are preferably performed in order to increase an impregnation speed.

The impregnation amount of the vinyl compound into polyurethane should be determined depending on types of the vinyl compound and polyurethane to be used and properties of a polishing pad to be manufactured. Therefore, the impregnation amount cannot be completely defined. However, for example, the content ratio of the polymer obtained from the vinyl compound and polyurethane in a polymerization-cured foamed structure is preferably 30/70 to 80/20 in terms of weight. When the content ratio of the polymer obtained from the vinyl compound is not less than 30/70 in terms of weight, hardness of the polishing pad can be made sufficiently high. Moreover, when the content ratio is not more than 80/20, elasticity of the polishing layer can be made sufficiently high.

Here, the content ratio of the polymer obtained from the polymerization-cured vinyl compound in polyurethane can be measured by a pyrolysis gas chromatography/mass spectrometry technique. An apparatus that can be used in this technique may include a double-shot pyrolyzer "PY-2010D" (manufactured by Frontier Laboratories Ltd.) as a thermal decomposition apparatus and "TRIO-1" (manufactured by VG) as a gas chromatography and mass spectrometry apparatus.

In the present invention, from a viewpoint of flatness of local unevenness of a semiconductor substrate, a phase of the polymer obtained from the vinyl compound and a phase of polyurethane are preferably contained without being separated from each other. When expressed quantitatively, it is preferable that an infrared spectrum obtained when the polishing pad be observed using an infrared microspectrometer with a spot size of 50 μm have an infrared absorption peak of the polymer polymerized from the vinyl compound and an infrared absorption peak of polyurethane, and that infrared spectra in various locations be approximately the same. An infrared microspectrometer to be used here may include IRμs manufactured by SPECTRA-TEC.

In order to improve properties, the polishing pad may contain various additives such as an abrasive, an antistatic agent, a lubricant, a stabilizer, and a dye.

In the present invention, in order to reduce poor local flatness and global steps, the density of the polishing layer is preferably not less than 0.3 g/cm$^3$, more preferably not less than 0.6 g/cm$^3$, and further preferably not less than 0.65 g/cm$^3$. On the other hand, in order to reduce scratches, the density is preferably not more than 1.1 g/cm$^3$, more preferably not more than 0.9 g/cm$^3$, and further preferably not more than 0.85 g/cm$^3$. Here, the density of the polishing layer in the present invention is a value measured using a Harvard-type pycnometer (in accordance with JIS R-3503 standard) with water as a medium.

Examples of a material to be polished in the present invention may include a surface of an insulating layer or a metal wiring formed on a semiconductor wafer. The insulating layer may include an interlayer insulating film of a metal wiring, a lower-layer insulating film of a metal wiring, and a shallow trench isolation layer used for element isolation. The metal wiring may be made from aluminum, tungsten, copper, or an alloy thereof. Examples of a structure of the metal wiring may include damascene, dual damascene, and a plug. When copper is used as the metal wiring, barrier metal such as silicon nitride also becomes a subject to be polished. Currently, silicon oxide is mainly used as the insulating film. However, a low dielectric constant insulating film is also used. In addition to a semiconductor wafer, a magnetic head, a hard disk, sapphire, SiC, MEMS (Micro Electro Mechanical Systems), and the like may be used as a subject to be polished.

The polishing method according to the present invention is suitably used in order to form a flat surface of glass, a semiconductor, a dielectric/metallic composite, an integrated circuit, and the like.

EXAMPLES

The present invention will be further described in detail by examples. However, the present invention should not be interpreted to be limited by the examples. Measurement was performed as below.

<Measurement of Cell Diameter>

Of cells observed in one field of view when observing a sample section at a magnification of 400 times using an ultra-deep microscope VK-8500 manufactured by Keyence Corporation, circular cells excluding cells that are observed in a circle in a state of being deficient in the field end are measured using an image processing apparatus to obtain a circle-equivalent diameter from the cross-sectional area. A number average value is calculated to serve as an average cell diameter.

<Measurement of Hardness>

Measurement was performed in accordance with JIS K6253-1997. The produced polyurethane resin was cut out into a piece having a size of 2 cm×2 cm (thickness: optional). The piece was used as a hardness measurement sample, and left to stand for 16 hours in an environment of a temperature of 23° C.±2° C. and a humidity of 50%±5%. During measurement, samples were superimposed on each other to have a thickness of not less than 6 mm. Hardness was measured using a hardness meter (manufactured by Kobunshi Keiki Co., Ltd., Asker D-type hardness meter).

<Measurement of Micro Rubber A Hardness>

A cushion layer was cut out into a piece having a size of 3 cm×3 cm. The piece was used as a hardness measurement sample, and left to stand for 16 hours in an environment of a temperature of 23° C.±2° C. and a humidity of 50%±5%. Different three points in one piece of sample were measured using a micro rubber hardness meter MD-1 manufactured by Kobunshi Keiki Co., Ltd. An average value was calculated to serve as a micro rubber A hardness.

<Measurement of Inclination Angle>

A pad having a groove formed on a polishing layer surface was disposed so that a razor blade was vertical to a groove direction. Then, the pad was sliced in a groove depth direction. The obtained groove section was observed by an ultra-deep microscope VK-8500 manufactured by Keyence Corporation. An angle (angle α) formed between a polishing surface and a side surface extending continuously to the groove polishing surface was measured. At locations of ⅓ and ⅔ of a radius from a pad center, the closest grooves were measured. An average of one each location, two locations in total, was calculated to serve as an inclination angle. An angle β was measured in a similar manner thereto.

<Measurement of Bending Point Depth>

A pad having a groove formed on a polishing layer surface was disposed so that a razor blade was vertical to a groove direction. Then, the pad was sliced in a groove depth direction. The obtained groove section was observed by an ultra-deep microscope VK-8500 manufactured by Keyence Corporation. A vertical distance from the polishing surface, to a midpoint between two bending points each including a first side surface and a second side surface and both facing each other, was measured. At locations of ⅓ and ⅔ of a radius from a pad center, the closest grooves were measured. An average of one each location, two locations in total, was calculated to serve as a bending point depth.

<Calculation of Distortion Constant>

A distortion constant was calculated according to the following equation:

$$\text{Distortion constant}(\mu m/Pa)=(T1-T2)/(177-27)/1000,$$

wherein T1 (μm) is a thickness when a pressure of 27 kPa was applied for 60 seconds with a dial gauge using an indenter having a leading end diameter of 5 mm, and T2 (μm) is a thickness when a pressure of 177 kPa was applied for 60 seconds thereafter.

<Calculation of Average Polishing Rate>

Using a polishing machine "Reflexion" for a 300 mm wafer manufactured by Applied Materials, Inc., polishing was performed while performing end point detection under a given polishing condition. Polishing properties were measured, excluding a region of less than 16 mm from the outermost circumference of a 12-inch wafer.

An average polishing rate (nm/minute) was calculated by measuring one point at the wafer center, two points at a radius of 5 mm in a diameter direction from the wafer center, 12 points with an interval of 20.0 mm in a region of more than 5 mm and not more than 125 mm, four points with an interval of 5.0 mm in a plane of more than 125 mm and not more than 130 mm, and two points at 134 mm.

<Calculation of In-Plane Uniformity of Polishing Rate>

The polishing properties of the 200th polished wafer were measured in a similar manner to the above, and calculation was performed according to the following equation:

In-plane uniformity of polishing rate(%)={(In-plane highest polishing rate)−(In-plane lowest polishing rate)}/(Average polishing rate)×100.

<Calculation of Polishing Rate Variation>

(When 200 Wafers were Polished)

After 200 wafers were polished and an average polishing rate was measured wafer by wafer, polishing rate variation (polishing rate variation after 200 wafers were polished) from the first to 200th wafers was calculated according to the following equation:

Polishing rate variation(%)={(Maximum wafer average polishing rate−(minimum wafer average polishing rate)}/(200th wafer average polishing rate).

(When Additional 500 Wafers were Polished)

After 500 wafers were additionally polished and an average polishing rate was measured wafer by wafer, polishing rate variation (polishing rate variation after 700 wafers were polished) from the first to 700th wafers was calculated according to the following equation:

Polishing rate variation(%)={(Maximum wafer average polishing rate)−(minimum wafer average polishing rate)}/(700th wafer average polishing rate).

When the variation of a polishing rate is large, insufficient polishing or excess polishing can cause device failure. Therefore, the polishing rate variation is suitably low, preferably not more than 30%, and more preferably not more than 20%.

Examples 1 to 16 and Comparative Examples 1 to 5 will be described below.

Example 1

In a RIM molding machine, 30 parts by weight of polypropylene glycol, 40 parts by weight of diphenylmethane diisocyanate, 0.5 parts by weight of water, 0.3 parts by weight of triethylamine, 1.7 parts by weight of a silicone foam stabilizer, and 0.09 parts by weight of tin octylate were mixed. The mixture was discharged into a mold and subjected to pressure molding. Thus, a foamed polyurethane sheet containing closed cells was produced.

The foamed polyurethane sheet was immersed in methyl methacrylate added with 0.2 parts by weight of azobisisobutyronitrile for 60 minutes. Next, the foamed polyurethane sheet was immersed in a solution including 15 parts by weight of polyvinyl alcohol "CP" (polymerization degree: about 500, manufactured by Nacalai Tesque Inc.), 35 parts by weight of ethyl alcohol (special grade chemical, manufactured by Katayama Chemical Co., Ltd.), and 50 parts by weight of water, and then dried. Thus, a surface layer of the foamed polyurethane sheet was coated with polyvinyl alcohol.

Next, the foamed polyurethane sheet was placed between two glass plates via vinyl chloride gaskets, and then heated for 6 hours at 65° C. and for 3 hours at 120° C. to be polymerization-cured. The sheet was released from between the glass plates, washed with water, and then vacuum-dried at 50° C. The hard foamed sheet obtained as above was subjected to a slicing process into a piece having a thickness of about 2 mm. Thus, a polishing layer was produced. The content ratio of methyl methacrylate in the polishing layer was 66% by weight. The polishing layer had a D hardness of 54 degrees and a density of 0.81 g/cm$^3$. An average cell diameter of closed cells was 45 μm.

Both surfaces of the obtained hard foamed sheet were ground. Thus, a polishing layer having a thickness of 2 mm was produced.

Thermoplastic polyurethane (cushion layer thickness: 0.3 mm, defined as cushion layer A) manufactured by Nihon Matai Co., Ltd. having a distortion constant of $1.5\times10^{-5}$ μm/Pa (micro rubber A hardness 89) as a cushion layer was laminated on the polishing layer obtained by the above method via an adhesive layer of MA-6203 manufactured by Mitsui Chemicals Polyurethanes, Inc. using a roll coater. In addition, a double-sided tape 5604TDM manufactured by Sekisui Chemical Co., Ltd. as a rear surface tape was bonded to the rear surface thereof. This laminate was punched into a circle having a diameter of 775 mm. A groove having a groove pitch of 15 mm, an angle α of 135 degrees, an angle β of 90 degrees, a groove depth in the deepest part of 1.5 mm, a bending point depth of 1 mm, a groove bottom part shape of a rectangle, and a groove width of 1 mm was formed in an XY grid pattern on a polishing layer surface. Thus, a polishing pad was obtained.

The polishing pad obtained by the above method was pasted on a platen of a polishing machine ("Reflexion" manufactured by Applied Materials, Inc.). Under a retainer ring pressure=67 kPa (9.7 psi), a zone 1 pressure=48 kPa (7 psi), a zone 2 pressure=28 kPa (4 psi), a zone 3 pressure=28 kPa (4 psi), a platen revolution=59 rpm, a polishing head revolution=60 rpm, a slurry (manufactured by Cabot Corporation, SS-25) flow of 300 mL/minute, 200 12-inch wafers as oxide films were polished using a dresser manufactured by Saesol at a load of 17.6 N (4 lbf), and a polishing time of 1 minute. The average polishing rate of the 200th oxide film was 307.7 nm/minute, and the in-plane uniformity of a polishing rate was 6.2%. The polishing rate variation after 200 oxide films were polished was 7.2%. The polishing rate variation after 700 wafers were polished when 500 wafers were further polished was 11.3%. Since a pad life that allows at least 700 wafers to be polished is necessary, the results were favorable.

Example 2

Polishing was performed in the same manner as that in Example 1, except that the angle α of the groove on the polishing layer surface was changed to 145 degrees, the groove width in the groove bottom part was changed to 0.7 mm, and the bending point depth was changed to 1.15 mm. The average polishing rate was 326.4 nm/minute, the in-plane uniformity of the polishing rate was 8.3%, and the polishing rate variation after 200 wafers were polished was 8.5%. The polishing rate variation after 700 wafers were polished when 500 wafers were further polished was 13.2%. Thus, the results were favorable.

Example 3

Polishing was performed in the same manner as that in Example 1, except that the angle α of the groove on the polishing layer surface was changed to 113 degrees, the groove width in the groove bottom part was changed to 0.7 mm, and the bending point depth was changed to 1.15 mm. The average polishing rate was 279.6 nm/minute, the in-plane uniformity of the polishing rate was 8.3%, and the polishing rate variation after 200 wafers were polished was 8.2%. The polishing rate variation after 700 wafers were polished when 500 wafers were further polished was 14.6%. Thus, the results were favorable.

Example 4

Polishing was performed in the same manner as that in Example 1, except that the angle α of the groove on the polishing layer surface was changed to 120 degrees, the groove width in the groove bottom part was changed to 0.7 mm, and the bending point depth was changed to 1.15 mm. The average polishing rate was 288.6 nm/minute, the in-plane uniformity of the polishing rate was 7.6%, and the polishing rate variation after 200 wafers were polished was 7.8%. The polishing rate variation after 700 wafers were polished when 500 wafers were further polished was 12.7%. Thus, the results were favorable.

Example 5

Polishing was performed in the same manner as that in Example 1, except that the angle α of the groove on the polishing layer surface was changed to 100 degrees, the groove width in the groove bottom part was changed to 0.7 mm, and the bending point depth was changed to 1.15 mm. The average polishing rate was 267.1 nm/minute, the in-plane uniformity of the polishing rate was 12.1%, and the polishing rate variation after 200 wafers were polished was 11.8%. The polishing rate variation after 700 wafers were polished when 500 wafers were further polished was 13.8%. Thus, the results were favorable.

Example 6

Polishing was performed in the same manner as that in Example 1, except that the angle α of the groove on the polishing layer surface was changed to 155 degrees, the groove width in the groove bottom part was changed to 0.7 mm, and the bending point depth was changed to 1.15 mm. The average polishing rate was 327.8 nm/minute, the in-plane uniformity of the polishing rate was 9.5%, and the polishing rate variation after 200 wafers were polished was 10.9%. The polishing rate variation after 700 wafers were polished when 500 wafers were further polished was 19.9%. Thus, the results were favorable.

Example 7

Polishing was performed in the same manner as that in Example 1, except that a polyolefin foamed body (PEF manufactured by Toray Industries, Inc., foaming ratio: 3 times, cushion layer thickness: 1.0 mm) having a distortion constant of $2.6\times10^{-4}$ μm/Pa (micro rubber A hardness 65 degrees) was used as a cushion layer (defined as cushion layer B). The average polishing rate was 275.8 nm/minute, the in-plane uniformity of the polishing rate was 6.3%, and the polishing rate variation after 200 wafers were polished was 15.4%. The polishing rate variation after 700 wafers were polished when 500 wafers were further polished was 14.8%. Thus, the results were favorable.

Example 8

Polishing was performed in the same manner as that in Example 1, except that the groove pitch on the polishing layer surface was changed to 11.5 mm, the bending point depth was changed to 1.15 mm, and the groove width in the groove bottom part was changed to 0.7 mm. The average polishing rate was 307.2 nm/minute, the in-plane uniformity of the polishing rate was 4.4%, and the polishing rate variation after 200 wafers were polished was 3.9%. The polishing rate variation after 700 wafers were polished when 500 wafers were further polished was 6.6%. Thus, the results were favorable.

Example 9

Polishing was performed in the same manner as that in Example 8, except that the polishing layer thickness was changed to 2.7 mm, and the bending point depth was changed to 1.8 mm. The average polishing rate was 300.4 nm/minute, the in-plane uniformity of the polishing rate was 4.6%, and the polishing rate variation after 200 wafers were polished was 4.4%. The polishing rate variation after 700 wafers were polished when 500 wafers were further polished was 9.3%. Thus, the results were favorable.

Example 10

Polishing was performed in the same manner as that in Example 8, except that the polishing layer thickness was changed to 3.1 mm, and the bending point depth was changed to 2.2 mm. The average polishing rate was 298.0 nm/minute, the in-plane uniformity of the polishing rate was 4.8%, and the polishing rate variation after 200 wafers were polished was 4.7%. The polishing rate variation after 700 wafers were polished when 500 wafers were further polished was 9.4%. Thus, the results were favorable.

Example 11

Polishing was performed in the same manner as that in Example 8, except that the polishing layer thickness was changed to 3.6 mm, and the bending point depth was changed to 2.7 mm. The average polishing rate was 297.7 nm/minute, the in-plane uniformity of the polishing rate was 5.2%, and the polishing rate variation after 200 wafers were polished was 5.1%. The polishing rate variation after 700 wafers were polished when 500 wafers were further polished was 9.9%. Thus, the results were favorable.

Example 12

Polishing was performed in the same manner as that in Example 8, except that the bending point depth was changed to 0.8 mm. The average polishing rate was 287.8 nm/minute, the in-plane uniformity of the polishing rate was 6.1%, and the polishing rate variation after 200 wafers were polished was 8.1%. The polishing rate variation after 700 wafers were polished when 500 wafers were further polished was 16.6%. Thus, the results were favorable.

Example 13

Polishing was performed in the same manner as that in Example 8, except that the bending point depth was changed to 0.45 mm. The average polishing rate was 287.2 nm/minute, the in-plane uniformity of the polishing rate was 6.5%, and the polishing rate variation after 200 wafers were polished was 8.8%. The polishing rate variation after 700 wafers were polished when 500 wafers were further polished was 19.1%. Thus, the results were favorable.

Example 14

Polishing was performed in the same manner as that in Example 8, except that two angles α that face each other via the groove on the polishing layer surface were changed to 135 degrees and 130 degrees so that the two angles facing each other differ from each other. The average polishing rate was 306.7 nm/minute, the in-plane uniformity of the polishing rate was 4.6%, and the polishing rate variation after 200 wafers were polished was 4.1%. The polishing rate variation after 700 wafers were polished when 500 wafers were further polished was 6.9%. Thus, the results were favorable.

Example 15

Polishing was performed in the same manner as that in Example 8, except that a polyester film having a thickness of 188 μm was bonded to the rear surface of the polishing layer via an adhesive, and a cushion layer was bonded to the polyester film surface. The average polishing rate was 312.6 nm/minute, the in-plane uniformity of the polishing rate was 4.1%, and the polishing rate variation after 200 wafers were polished was 4.2%. The polishing rate variation after 700 wafers were polished when 500 wafers were further polished was 6.5%. Thus, the results were favorable.

Example 16

Polishing was performed in the same manner as that in Example 1, except that a polyolefin foamed body (PEF manufactured by Toray Industries, Inc., foaming ratio: 4 times, cushion layer thickness: 1.0 mm) having a distortion constant of $3.8\times10^{-4}$ μm/Pa (micro rubber A hardness 57 degrees) was used as a cushion layer (defined as cushion layer C). The average polishing rate was 279.8 nm/minute, the in-plane uniformity of the polishing rate was 11.3%, and the polishing rate variation after 200 wafers were polished was 18.3%. The polishing rate variation after 700 wafers were polished when 500 wafers were further polished was 17.3%. Thus, the results were favorable.

Comparative Example 1

Polishing was performed in the same manner as that in Example 1, except that the angle α of the groove on the polishing layer surface was changed to 90 degrees, and the groove had a simple "C" shape. The average polishing rate was 255.3 nm/minute, the in-plane uniformity of the polishing rate was 14.2%, and the polishing rate variation after 200 wafers were polished was 42.3%. The polishing rate was low, the in-plane uniformity of the polishing rate was not favorable, and the polishing rate variation was large. That is, polishing could not be performed in a preferred manner after 200 wafers were polished, and the polishing layer could not be used for polishing the 200th wafer and later (for example, 700 wafers).

Comparative Example 2

Polishing was performed in the same manner as that in Example 1, except that non-woven fabric (cushion layer thickness: 1.3 mm) having a distortion constant of $6.5\times10^{-4}$ μm/Pa is used as a cushion layer (defined as cushion layer D). The average polishing rate was 275.8 nm/minute, the in-plane uniformity of the polishing rate was 8.9%, and the polishing rate variation after 200 wafers were polished was 78.8%. Thus, the polishing rate variation was large. That is, polishing could not be performed in a preferred manner after 200 wafers were polished, and the polishing layer could not be used for polishing the 200th wafer and later (for example, 700 wafers).

Comparative Example 3

Polishing was performed in the same manner as that in Example 8, except that the bending point depth was changed to 0.2 mm. The average polishing rate was 286.9 nm/minute, and the in-plane uniformity of the polishing rate was 10.4%. Although the polishing rate variation after 200 wafers were polished was 11.4%, the polishing rate variation after 700 wafers were polished was 35.5%. Thus, the polishing rate variation was large.

Comparative Example 4

Polishing was performed in the same manner as that in Example 8, except that the bending point depth was changed to 0.3 mm. The average polishing rate was 285.5 nm/minute, and the in-plane uniformity of the polishing rate was 9.8%. Although the polishing rate variation after 200 wafers were polished was 10.9%, the polishing rate variation after 700 wafers were polished when 500 wafers were further polished was 32.7%. Thus, the polishing rate variation was large.

Comparative Example 5

Polishing was performed in the same manner as that in Example 1, except that Nipparon EXT (cushion layer thickness: 0.8 mm, defined as cushion layer E) manufactured by NHK Spring Co., Ltd. having a distortion constant of $5.2\times10^{-4}$ μm/Pa (micro rubber A hardness 59 degrees) was used as a cushion layer. The average polishing rate was 280.6 nm/minute, the in-plane uniformity of the polishing rate was 12.8%, and the polishing rate variation after 200 wafers were polished was 74.8%. Thus, the polishing rate variation was large. That is, polishing could not be performed in a preferred manner after 200 wafers were polished, and the polishing layer could not be used for polishing the 200th wafer and later (for example, 700 wafers).

The results obtained in Examples 1 to 16 and Comparative Examples 1 to 5 described above are shown in Table 1.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| α (degrees) | 135 | 145 | 113 | 120 | 100 | 155 | 135 | 135 | 135 | 135 | 135 |
| β (degrees) | 90 | 90 | 90 | 90 | 90 | 90 | 90 | 90 | 90 | 90 | 90 |
| Polishing Layer Thickness (mm) | 2 | 2 | 2 | 2 | 2 | 2 | 2 | 2 | 2.7 | 3.1 | 3.6 |
| Groove Pitch (mm) | 15 | 15 | 15 | 15 | 15 | 15 | 15 | 11.5 | 11.5 | 11.5 | 11.5 |
| Groove Depth (mm) | 1.5 | 1.5 | 1.5 | 1.5 | 1.5 | 1.5 | 1.5 | 1.5 | 1.5 | 1.5 | 1.5 |
| Groove Width of Groove Bottom (mm) | 1 | 0.7 | 0.7 | 0.7 | 0.7 | 0.7 | 1 | 0.7 | 0.7 | 0.7 | 0.7 |
| Bending Point Depth (mm) | 1 | 1.15 | 1.15 | 1.15 | 1.15 | 1.15 | 1 | 1.15 | 1.8 | 2.2 | 2.7 |
| Average Polishing Rate (nm/min.) | 307.7 | 326.4 | 279.6 | 288.6 | 267.1 | 327.8 | 275.8 | 307.2 | 300.4 | 298.0 | 297.7 |

TABLE 1-continued

| | | | | | | | | | | | |
|---|---|---|---|---|---|---|---|---|---|---|---|
| In-plane Uniformity of Polishing Rate (%) | 6.2 | 8.3 | 8.3 | 7.6 | 12.1 | 9.5 | 6.3 | 4.4 | 4.6 | 4.8 | 5.2 |
| Polishing Rate Variation After 200 Wafers Polished (%) | 7.2 | 8.5 | 8.2 | 7.8 | 11.8 | 10.9 | 15.4 | 3.9 | 4.4 | 4.7 | 5.1 |
| Polishing Rate Variation After 700 Wafers Polished (%) | 11.3 | 13.2 | 14.6 | 12.7 | 13.8 | 19.9 | 14.8 | 6.6 | 9.3 | 9.4 | 9.9 |
| Cushion Layer | A | A | A | A | A | A | B | A | A | A | A |

| | Ex. 12 | Ex. 13 | Ex. 14 | Ex. 15 | Ex. 16 | Comp. Ex. 1 | Comp. Ex. 2 | Comp. Ex. 3 | Comp. Ex. 4 | Comp. Ex. 5 |
|---|---|---|---|---|---|---|---|---|---|---|
| α (degrees) | 135 | 135 | 135, 130 | 135 | 135 | 90 | 135 | 135 | 135 | 135 |
| β (degrees) | 90 | 90 | 90 | 90 | 90 | 90 | 90 | 90 | 90 | 90 |
| Polishing Layer Thickness (mm) | 2 | 2 | 2 | 2 | 2 | 2 | 2 | 2 | 2 | 2 |
| Groove Pitch (mm) | 11.5 | 11.5 | 11.5 | 11.5 | 15 | 15 | 15 | 11.5 | 11.5 | 15 |
| Groove Depth (mm) | 1.5 | 1.5 | 1.5 | 1.5 | 1.5 | 1.5 | 1.5 | 1.5 | 1.5 | 1.5 |
| Groove Width of Groove Bottom (mm) | 0.7 | 0.7 | 0.7 | 0.7 | 1 | 1 | 1 | 0.7 | 0.7 | 1 |
| Bending Point Depth (mm) | 0.8 | 0.45 | 1.15 | 1.15 | 1 | 1 | 1 | 0.2 | 0.3 | 1 |
| Average Polishing Rate (nm/min.) | 287.8 | 287.2 | 306.7 | 312.6 | 279.8 | 255.3 | 275.8 | 286.9 | 285.5 | 280.6 |
| In-plane Uniformity of Polishing Rate (%) | 6.1 | 6.5 | 4.6 | 4.1 | 11.3 | 14.2 | 8.9 | 10.4 | 9.8 | 12.8 |
| Polishing Rate Variation After 200 Wafers Polished (%) | 8.1 | 8.8 | 4.1 | 4.2 | 18.3 | 42.3 | 78.8 | 11.4 | 10.9 | 74.8 |
| Polishing Rate Variation After 700 Wafers Polished (%) | 16.6 | 19.1 | 6.9 | 6.5 | 17.3 | — | — | 35.5 | 32.7 | — |
| Cushion Layer | A | A | A | A | C | A | D | A | A | E |

Example 15: Polyester film having thickness of 188 μm bonded to polishing layer rear surface + cushion layer bonded to polyester film surface
Comparative Example 1: C-shaped groove

REFERENCE SIGNS LIST

1, 2, 3, 4 Polishing pad
10 Polishing layer
11 Polishing surface
12, 17, 19, 21 Groove
13 First side surface
14 Bending point
15 Second side surface
16, 18, 20, 22 Deepest part
30 Cushion layer

The invention claimed is:

1. A polishing pad comprising at least a polishing layer and a cushion layer, wherein the polishing layer comprises a groove on a polishing surface, the groove having side surfaces and a bottom surface, at least one of the side surfaces comprises a first side surface that extends continuously to the polishing surface and forms an angle α with the polishing surface, and a second side surface that extends continuously to the first side surface and forms an angle β with a plane parallel to the polishing surface, the angle α formed with the polishing surface is larger than 90 degrees, the angle β formed with the plane parallel to the polishing surface is not smaller than 85 degrees, and the angle β formed with the plane parallel to the polishing surface is smaller than the angle α formed with the polishing surface, a bending point depth from the polishing surface to a bending point between the first side surface and the second side surface is not less than 0.4 mm and not more than 3.0 mm, and the cushion layer has a distortion constant of not less than $7.3\times10^{-6}$ μm/Pa and not more than $4.4\times10^{-4}$ μm/Pa.

2. The polishing pad according to claim 1, wherein a difference between the angle α formed with the polishing surface and the angle β formed with the plane parallel to the polishing surface is not smaller than 10 degrees and not larger than 65 degrees.

3. The polishing pad according to claim 1, wherein the angle α formed with the polishing surface is not smaller than 105 degrees and not larger than 150 degrees.

4. The polishing pad according to claim 1, wherein the angle β formed with the plane parallel to the polishing surface is not smaller than 85 degrees and not larger than 95 degrees.

5. The polishing pad according to claim 1, wherein a groove pattern on the polishing surface is grid-shaped.

6. The polishing pad according to claim 1, wherein the cushion layer has a distortion constant of not less than $1.0\times10^{-5}$ μm/Pa.

7. The polishing pad according to claim 1, wherein the cushion layer has a distortion constant not more than $1.2\times10^{-5}$ μm/Pa.

* * * * *